US005754928A

United States Patent [19]

Moe et al.

[11] Patent Number: 5,754,928

[45] Date of Patent: *May 19, 1998

[54] SQUEEGEE APPARATUS AND METHOD FOR REMOVING DEVELOPER LIQUID FROM AN IMAGING SUBSTRATE

[75] Inventors: Edward J. Moe, St. Paul; Truman F. Kellie, Lakeland; Steven C. Jensen, Maplewood, all of Minn.

[73] Assignee: Minnesota Mining and Manufacturing Company, Saint Paul, Minn.

[ * ] Notice: The term of this patent shall not extend beyond the expiration date of Pat. No. 5,576,815.

[21] Appl. No.: 811,660

[22] Filed: Mar. 4, 1997

Related U.S. Application Data

[63] Continuation of Ser. No. 537,128, Sep. 29, 1995, abandoned.

[51] Int. Cl.[6] ..... G03G 15/10

[52] U.S. Cl. ..... 399/249; 399/237

[58] Field of Search ..... 399/237, 239, 399/249; 492/17, 18, 28, 29, 30, 40, 41, 43, 44; 15/256.51, 256.52

[56] References Cited

U.S. PATENT DOCUMENTS

| | | | |
|---|---|---|---|
| Re. 34,437 | 11/1993 | Ariyama et al. | 355/307 |
| 3,654,659 | 4/1972 | Blumenthal . | |
| 3,710,469 | 1/1973 | Kitazawa . | |
| 3,741,643 | 6/1973 | Smith et al. | 355/256 |
| 3,750,246 | 8/1973 | Pessen . | |
| 3,815,989 | 6/1974 | Davis et al. | 355/256 X |
| 3,843,407 | 10/1974 | Thorp . | |
| 3,850,099 | 11/1974 | Laben et al. . | |
| 3,910,231 | 10/1975 | Inoue et al. . | |
| 3,940,282 | 2/1976 | Hwa . | |
| 3,955,533 | 5/1976 | Smith et al. | 118/652 |
| 4,181,094 | 1/1980 | Gardiner . | |
| 4,325,627 | 4/1982 | Swidler et al. | 355/256 |

(List continued on next page.)

FOREIGN PATENT DOCUMENTS

| | | |
|---|---|---|
| 575 698 | 12/1993 | European Pat. Off. . |
| 0 657 786 A1 | 6/1995 | European Pat. Off. . |
| 53-22435 | 1/1978 | Japan . |
| 55-015190 | 2/1980 | Japan . |
| 60-060678 | 4/1985 | Japan . |
| 4-69680 | 3/1992 | Japan . |
| 5-19634 | 1/1993 | Japan . |
| 6-95472 | 4/1994 | Japan . |
| 1 579 405 | 11/1980 | United Kingdom . |

OTHER PUBLICATIONS

Patent Abstracts of Japan, vol. 17, No. 308, p. 1555, 05–027653, S. Hirahata, Feb. 1993.

Patent Abstracts of Japan, vol. 17, No. 293, p. 1550, 05–019634, T. Katou et al., Jan. 1993.

Patent Abstracts of Japan, vol. 16, No. 386, p. 1404, 04–125672, M. Kishi, Apr. 1992.

Patent Abstracts of Japan, vol. 14, No. 484, p. 1120, 02–196267, E. Shiozawa et al., Aug. 1990.

Patent Abstracts of Japan, vol. 13, No. 85, p. 834, 63–266475, M. Arai, Nov. 1988.

Patent Abstracts of Japan, vol. 4, No. 160, p. 35, 55–106480, T. Otani et al., Aug. 1980.

IBM Technical Disclosure Bulletin, Jun. 1984, vol. 27, No. 1a, pp. 170–171, "Uniform Pressure Roll".

*Primary Examiner*—Matthew S. Smith

*Attorney, Agent, or Firm*—William D. Bauer

[57] ABSTRACT

A squeegee apparatus and method for removing excess developer liquid from an imaging substrate in a liquid electrographic imaging system make use of a squeegee roller having a core with a crowned profile. With determination of a proper loading force, the squeegee apparatus and method achieve substantially uniform loading force along the length of the squeegee roller, and thus along the width of a nip formed along an the imaging region of the imaging substrate. As a result, the squeegee apparatus and method provide substantially uniform removal of developer liquid from the imaging substrate, enhancing quality of an ultimate printed image.

30 Claims, 3 Drawing Sheets

U.S. PATENT DOCUMENTS

| | | | |
|---|---|---|---|
| 4,395,113 | 7/1983 | Buchan et al. | 355/297 |
| 4,416,201 | 11/1983 | Kessler . | |
| 4,436,054 | 3/1984 | Ceelen et al. | 118/652 |
| 4,482,242 | 11/1984 | Moraw et al. . | |
| 4,627,705 | 12/1986 | Landa et al. | 355/256 X |
| 4,640,605 | 2/1987 | Ariyama et al. | 355/256 X |
| 4,669,859 | 6/1987 | Mochizuki et al. | 355/246 |
| 4,682,881 | 7/1987 | Komatsubara et al. | 355/256 X |
| 4,728,987 | 3/1988 | Diola et al. | 355/245 |
| 4,801,965 | 1/1989 | Mochizuki et al. | 355/307 X |
| 4,905,047 | 2/1990 | Ariyama | 355/256 |
| 4,935,788 | 6/1990 | Fantuzzo et al. | 355/326 |
| 4,956,211 | 9/1990 | Saito | 428/36.5 |
| 4,990,962 | 2/1991 | Kishi . | |
| 5,021,834 | 6/1991 | Tsuruoka et al. | 355/256 |
| 5,092,235 | 3/1992 | Rise | 100/168 |
| 5,122,839 | 6/1992 | Siegel et al. . | |
| 5,155,534 | 10/1992 | Kurotori et al. | 355/256 |
| 5,195,430 | 3/1993 | Rise | 100/168 |
| 5,220,384 | 6/1993 | Landa et al. | 355/256 |
| 5,221,944 | 6/1993 | Yoda et al. | 355/256 |
| 5,262,259 | 11/1993 | Chou et al. | 430/47 |
| 5,289,238 | 2/1994 | Lior et al. | 355/256 |
| 5,300,990 | 4/1994 | Thompson | 355/256 |
| 5,359,398 | 10/1994 | Echigo et al. . | |
| 5,369,477 | 11/1994 | Foote et al. | 355/256 |
| 5,374,980 | 12/1994 | Kubo et al. | 355/256 |
| 5,384,225 | 1/1995 | Kurotori et al. . | |
| 5,420,675 | 5/1995 | Thompson et al. . | |
| 5,420,676 | 5/1995 | Arcaro . | |
| 5,432,591 | 7/1995 | Geleynse | 355/256 |
| 5,463,453 | 10/1995 | Kurotori et al. . | |
| 5,576,815 | 11/1996 | Teschendorf et al. . | |

SQUEEGEE APPARATUS AND METHOD FOR REMOVING DEVELOPER LIQUID FROM AN IMAGING SUBSTRATE

This is a continuation of application Ser. No. 08/537,128 filed Sep. 29, 1995 now abandoned.

FIELD OF THE INVENTION

The present invention relates generally to liquid electrographic imaging technology and, more particularly, to techniques for removing excess developer liquid from an imaging substrate in a liquid electrographic imaging system.

DISCUSSION OF RELATED ART

A liquid electrographic imaging system includes an imaging substrate onto which a developer liquid is delivered to develop a latent image. A liquid electrographic imaging system may comprise as the imaging substrate a dielectric or a photoreceptor. A photoreceptor includes a photoconductive material. A latent image can be formed on a photoreceptor by selectively discharging the photoreceptor with a pattern of radiation, whereas a latent image can be formed on a dielectric by selectively discharging the dielectric with an electrostatic stylus. A liquid electrophotographic imaging system will be discussed for purposes of example.

A liquid electrophotographic imaging system generally includes a photoreceptor, an erasure station, a charging station, an exposure station, a development station, an image drying station, and a transfer station. The photoreceptor may take the form of a photoreceptor belt, a photoreceptor drum, or a photoreceptor sheet. For an imaging operation, the photoreceptor is moved past each of the stations in the liquid electrophotographic imaging system.

The erasure station exposes the photoreceptor to erase radiation sufficient to uniformly discharge any electrostatic charge remaining from a previous imaging operation. The charging station electrostatically charges the surface of the photoreceptor. The exposure station selectively discharges the surface of the photoreceptor to form a latent electrostatic image. A multi-color imaging system may include several exposure stations that form a plurality of latent images. Each of the latent images in a multi-color imaging system is representative of one of a plurality of color separation images for an original multi-color image to be reproduced.

As a latent image is formed, the development station transfers developer liquid to the photoreceptor via a development roller to develop the latent image. In a multi-color imaging system, each of a plurality of development stations applies an appropriately colored developer liquid to the photoreceptor to form an intermediate representation of the corresponding color separation image. The drying station dries the developer liquid applied by the development station or stations. The transfer station then transfers the developer liquid applied by the development stations from the photoreceptor to an imaging substrate, such as a sheet of paper, to form a visible representation of the original image.

In addition to a development roller, the development station typically includes a squeegee roller. The squeegee roller removes excess developer liquid from the photoreceptor to partially dry the developed image prior to application of the drying and transfer stations to the photoreceptor. The squeegee roller is loaded against the photoreceptor to form a nip that prevents excess developer liquid from passing downstream with the photoreceptor. The squeegee roller ordinarily comprises an elastomeric material mounted about a right circular cylindrical core. The length of the squeegee roller is at least as long as the width of the imaging region of the photoreceptor to effectively remove excess developer liquid from the imaging region. The diameter of the squeegee roller must be minimized due to space constraints within the overall imaging system.

The squeegee roller is loaded against the photoreceptor by applying loading force at opposite ends of the core. Application of loading force at opposite ends of the core can cause axial deflection of the right circular cylindrical core when the squeegee roller is loaded against the photoreceptor. The axial deflection causes the loading force along the nip between the squeegee roller and the photoreceptor to be nonuniform. For example, the loading force at the midpoint of the squeegee roller can be significantly less than the loading force at the ends of the squeegee roller. Due to the length-to-diameter ratio of the core, this nonuniformity is accentuated. Nonuniform loading force along the length of the squeegee roller can cause nonuniform removal of the excess developer liquid from the photoreceptor. In particular, areas of the image at the center of the nip can be more wet than lateral areas. The wet areas can adversely affect the transfer of the developed image to intermediate rollers and the ultimate printing substrate. Therefore, the nonuniform operation of the squeegee roller along the width of the imaging region can cause visible nonuniformities in the developed image, degrading image quality in the ultimate printed image.

In view of the image quality concerns raised by the nonuniformities described above, there is a need for an improved squeegee apparatus for removing excess developer liquid from an imaging substrate in a liquid electrographic printing system. In particular, there is a need for an improved squeegee apparatus that achieves more uniform loading force along the length of a squeegee roller, and thus along the width of the imaging region of the imaging substrate.

SUMMARY OF THE INVENTION

The present invention is directed to a squeegee apparatus and method for removing excess developer liquid from an imaging substrate in a liquid electrographic imaging system. The present invention also is directed to a liquid electrographic imaging system incorporating such a squeegee apparatus. Further, the present invention is directed to a method for fabricating a squeegee roller for use in such a squeegee apparatus. The squeegee apparatus and method of the present invention achieve substantially uniform loading force along the length of the squeegee roller, and thus along the width of the imaging region of the imaging substrate. As a result, the squeegee apparatus and method provide substantially uniform removal of excess developer liquid from the imaging substrate, and enhanced image quality.

A squeegee apparatus, in accordance with the present invention, comprises a squeegee roller having a shaft with a first end, a second end, and a core extending between the first end and the second end along a longitudinal axis of the shaft, and an elastomeric material formed about the core, wherein the core has a cross-sectional area oriented perpendicular to the longitudinal axis that varies along the longitudinal axis, and a loading mechanism for applying a loading force to each of the first end and the second end to load the core of the squeegee roller against the imaging substrate, thereby forming a pressure nip between the elastomeric material and the imaging substrate, wherein the cross-sectional area of the core and the loading force applied to each of the first end and the second end are selected to produce a substantially uniform pressure along the nip, the squeegee roller thereby removing excess developer liquid from the imaging substrate in a substantially uniform manner.

A squeegee method, in accordance with the present invention, comprises the steps of providing a squeegee roller having a shaft with a first end, a second end, and a core extending between the first end and the second end along a longitudinal axis of the shaft, and an elastomeric material formed about the core, wherein the core has a cross-sectional area oriented perpendicular to the longitudinal axis that varies along the longitudinal axis, and applying a loading force to each of the first end and the second end to load the core of the squeegee roller against the imaging substrate, thereby forming a pressure nip between the elastomeric material and the imaging substrate, wherein the cross-sectional area of the core and the loading force applied to each of the first end and the second end are selected to produce a substantially uniform pressure along the nip, the squeegee roller thereby removing excess developer liquid from the imaging substrate in a substantially uniform manner.

A liquid electrographic imaging system, in accordance with the present invention, comprises an imaging substrate, means for moving the imaging substrate in a first direction, an exposure station for exposing an imaging region of the imaging substrate to a pattern of radiation to form a latent electrostatic image on the imaging region of the imaging substrate, a development station for delivering developer liquid to the imaging region of the imaging substrate to develop the latent electrostatic image, a squeegee apparatus for removing excess developer liquid from the imaging substrate, the squeegee apparatus comprising a squeegee roller having a shaft with a first end, a second end, and a core extending between the first end and the second end along a longitudinal axis of the shaft, and an elastomeric material formed about the core, wherein the core has a cross-sectional area oriented perpendicular to the longitudinal axis that varies along the longitudinal axis, and a loading mechanism for applying a loading force to each of the first end and the second end to load the core of the squeegee roller against the imaging substrate, thereby forming a pressure nip between the elastomeric material and the imaging substrate, wherein the cross-sectional area of the core and the force applied to each of the first end and the second end are selected to produce a substantially uniform pressure along the nip, the squeegee roller thereby removing excess developer liquid from the imaging substrate in a substantially uniform manner, and means for transferring the developer liquid remaining on the imaging region of the imaging substrate to an imaging substrate, thereby forming a visible representation of an image.

A method for fabrication of a squeegee roller, in accordance with the present invention, comprises the steps of forming a shaft with a first end, a second end, and a core extending between the first end and the second end along a longitudinal axis of the shaft, wherein the core has a cross-sectional area oriented perpendicular to the longitudinal axis that varies along the longitudinal axis, placing at least the core of the shaft in a mold, injecting an elastomeric material into the mold to form the elastomeric material about the core, allowing the elastomeric material to at least partially set, removing the elastomeric material and the core of the shaft from the mold.

The advantages of the present invention will be set forth in part in the description that follows, and in part will be apparent from the description, or may be learned by practice of the present invention. The advantages of the present invention will be realized and attained by means particularly pointed out in the written description and claims, as well as in the appended drawings. It is to be understood, however, that both the foregoing general description and the following detailed description are exemplary and explanatory only, and not restrictive of the present invention, as claimed.

BRIEF DESCRIPTION OF THE DRAWINGS

The accompanying drawings are included to provide a further understanding of the present invention and are incorporated in and constitute a part of this specification. The drawings illustrate exemplary embodiments of the present invention and together with the description serve to explain the principles of the invention.

DETAILED DESCRIPTION OF THE PREFERRED EMBODIMENTS

Figure 1:
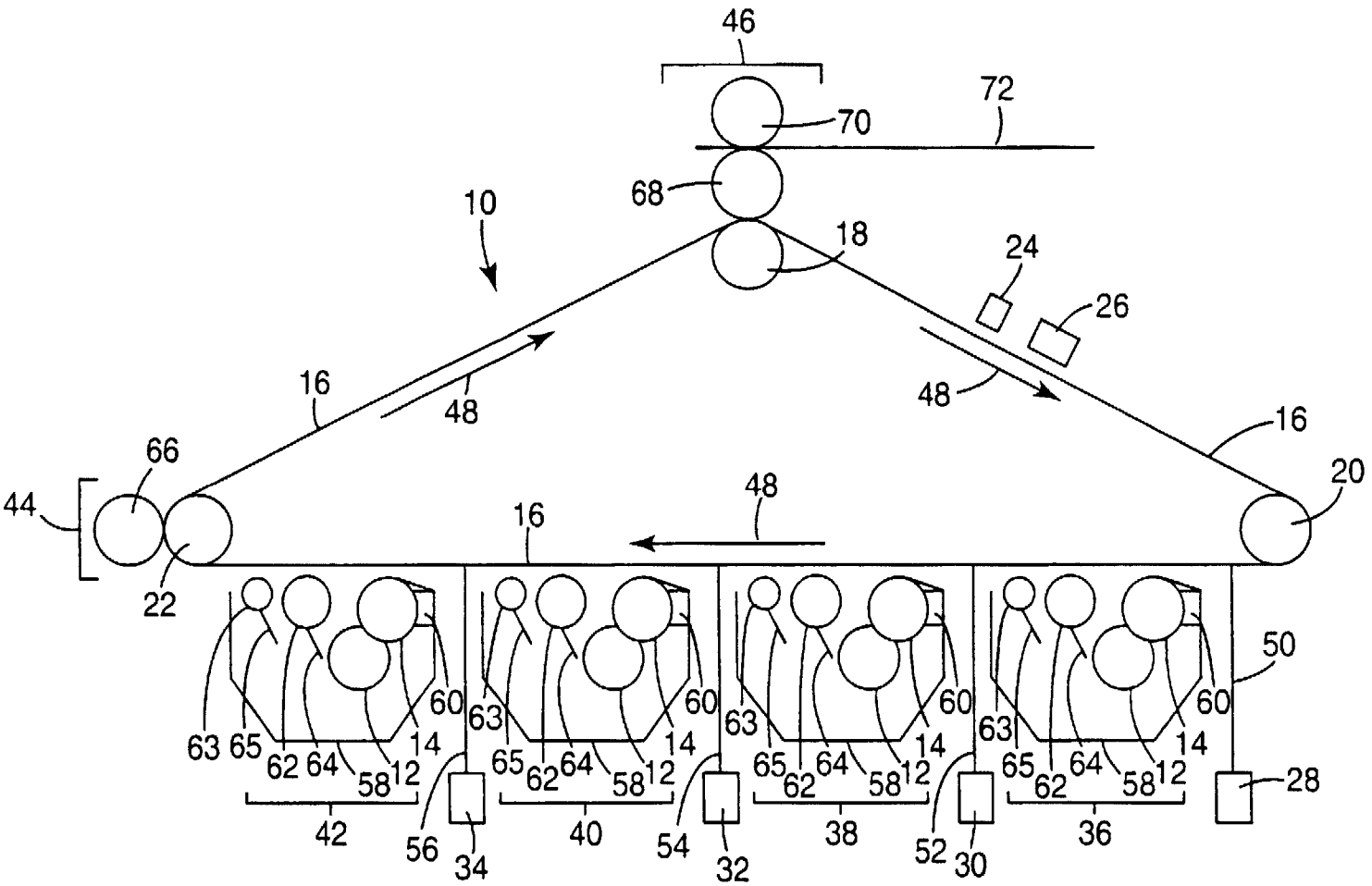
FIG. 1 is a schematic diagram of an exemplary liquid electrographic imaging system.

FIG. 1 is a schematic diagram of an exemplary liquid electrographic imaging system 10 incorporating a squeegee roller 12. The squeegee roller 12 forms part of a squeegee apparatus, in accordance with the present invention. The squeegee roller 12 can be mounted, for example, adjacent a development device such as a development roller 14 in a development station. The squeegee roller 12 will be described in detail later in this description. In FIG. 1, system 10 is shown as an electrophotographic imaging system having a photoreceptor 16 as an imaging substrate. The system 10 is configured to form a multi-color image in a single pass of a photoreceptor 16 associated with the system. The single-pass system 10 enables multi-color images to be assembled at extremely high speeds. An example of a liquid electrophotographic imaging system configured to assemble a multi-color image in a single pass of a photoreceptor is disclosed in copending and commonly assigned U.S. patent application Ser. No. 08/537,296, filed Sep. 29, 1995, entitled "METHOD AND APPARATUS FOR PRODUCING A MULTI-COLORED IN AN ELECTROPHOTOGRAPHIC SYSTEM." The entire content of the above-referenced patent application is incorporated herein by reference.

Although imaging system 10 is shown as a multicolor/single-pass system in FIG. 1, the squeegee apparatus of the present invention can be readily applied to remove excess developer liquid from a photoreceptor in both single-color liquid electrographic imaging systems and multi-color/multi-pass liquid electrographic imaging systems. In addition, the squeegee apparatus of the present invention can be readily applied to remove developer liquid in systems in which the photoreceptor is configured as a photoreceptor belt, a photoreceptor drum, or a photoreceptor sheet.

Similarly, the squeegee apparatus of the present invention can be applied to remove developer liquid in multicolor/multi-pass, multi-color/single-pass, or single-color electrographic systems incorporating a dielectric belt, drum, or sheet as the imaging substrate. Therefore, incorporation of the apparatus of the present invention in the particular multi-color, single-pass electrophotographic imaging system 10 of FIG. 1 should be considered exemplary only.

As shown in FIG. 1, imaging system 10 includes photoreceptor 16 in the form of a continuous photoreceptor belt mounted about first, second, and third belt rollers 18, 20, 22, an erasure station 24, a charging station 26, a plurality of exposure stations 28, 30, 32, 34, a plurality of development stations 36, 38, 40, 42, a drying station 44, and a transfer station 46. In operation of system 10, photoreceptor 16 is moved to travel in a first direction indicated by arrows 48. The photoreceptor 16 can be moved, for example, by activating a motor coupled to a rotor shaft associated with one of belt rollers 18, 20, 22. As photoreceptor 16 moves in first direction 48, erasure station 24 exposes the photoreceptor to erase radiation to uniformly discharge any electrostatic charge remaining from a previous imaging operation. The charging station 26 then charges the surface of photoreceptor 16 to a predetermined level.

The exposure stations 28, 30, 32, 34 emit beams 50, 52, 54, 56 of radiation that selectively discharge an imaging region of the charged photoreceptor 16 in an imagewise pattern to form a latent electrostatic image. Each of exposure stations 28, 30, 32, 34 may comprise, for example, a scanning laser module. For multi-color imaging, each of exposure stations 28, 30, 32, 34 forms a latent image representative of one of a plurality of color separation images of an original image to be reproduced. The combination of the color separation images produces an overall multi-color representation of the original image. The exposure stations 28, 30, 32, 34 emit radiation beams 50, 52, 54, 56, respectively, to form latent images in the same imaging region of photoreceptor 16. Thus, each of exposure stations 28, 30, 32, 34 forms a latent image on photoreceptor 16 as the imaging region passes the respective exposure station.

As further shown in FIG. 1, each of development stations 36, 38, 40, 42 may include squeegee roller 12, a development device such as development roller 14, a developer liquid recovery reservoir 58, a plenum 60 for delivering developer liquid to the development roller, and a blade 64 for removing developer liquid from the squeegee roller. As an alternative to development roller 14, each of development stations 36, 38, 40, 42 may include a development belt or other development device. An example of a development station including structure conforming substantially to that of developer stations 36, 38, 40, 42 is disclosed in U.S. patent application Ser. No. 08/536,135, filed Sep. 29, 1995, entitled "DEVELOPMENT APPARATUS FOR A LIQUID ELECTROGRAPHIC IMAGING SYSTEM." The entire content of the above-referenced patent application is incorporated herein by reference.

The development roller 14 is in fluid communication, via plenum 60, with a source of one of a plurality of differently colored developer liquids corresponding to the particular color separation to be developed. The developer liquid can be pumped from the source to plenum 60 for application to the surface of development roller 14. Alternatively, the surface of development roller 14 could be placed in contact with the source of developer liquid, or with another roller delivering developer liquid, eliminating the need for a pump and plenum 60. The differently colored developer liquids may correspond, for example, to cyan, magenta, yellow, and black color separations.

In this description, the term "developer liquid" generally refers to the liquid applied to an imaging substrate such as photoreceptor 20 to develop a latent image. The "developer liquid" may comprise both toner particles and a carrier liquid in which the toner particles are dispersed. A suitable carrier liquid may comprise, for example, hydrocarbon solvents such as NORPAR or ISOPAR solvents commercially available from Exxon. Examples of suitable developer liquids are disclosed in copending and commonly assigned U.S. patent application Ser. No. 08/536,856, filed Sep. 29, 1995, entitled "LIQUID INK USING A GEL ORGANOSOL." The entire content of the above-referenced patent application is incorporated herein by reference.

The development roller 14 can be made, for example, from stainless steel. Each of development stations 36, 38, 40, 42 may include means for engaging development roller 14 in proximity with photoreceptor 16 to develop the appropriate latent image in an imaging region of the photoreceptor. A suitable engaging means may comprise, for example, any of a variety of camming or gear-driven mechanisms configured to move one or both of development roller 14 and photoreceptor 16 relative to one another. During engagement, development roller 14 is positioned a short distance from the surface of photoreceptor 16, forming a gap. In addition, development roller 4 is moved to travel in first direction 48 by, for example, activating a motor coupled to a rotor shaft associated with the development roller. The development roller 14 supplies a thin, uniform layer of developer liquid across the gap to photoreceptor 16.

To carry out the application of developer liquid, each of development stations 36, 38, 40, 42 further includes an electrical bias means (not shown) that creates an electric field between development roller 14 and photoreceptor 16. The electric field develops the latent image previously formed by the respective exposure station 28, 30, 32, 34 with the developer liquid applied by development roller 14. The electrical bias means may comprise a charging circuit that applies to the surface of development roller 14 a charge that induces the electric field. The development roller 14 applies developer liquid to photoreceptor 16 only long enough to develop an imaging region of the photoreceptor. Upon movement of a nonimaging region of photoreceptor 16 past development roller 14, the application of developer liquid by the development roller is terminated. The application of developer liquid can be terminated by, for example, disengaging development roller 14 from proximity with photoreceptor 16, turning off the supply of developer liquid to the development roller, or obstructing the application of developer liquid from the development roller with a blade or other obstructing element. For termination of developer liquid application by disengagement, development roller 14 can be disengaged by reverse action of the same mechanism used for engagement.

A portion of the developer liquid can become back-plated on development roller 14. The back-plated developer liquid can alter the electrical properties of development roller 14, and can thereby affect uniformity of development. To avoid nonuniformity, it may be desirable to incorporate in each of development stations 36, 38, 40, 42 a means for removing the back-plated developer liquid. As shown in FIG. 1, the means for removing back-plated developer liquid may comprise a cleaning roller 61. A suitable cleaning roller for removing the back-plated developer liquid from development roller 14 is disclosed, for example, in copending and commonly assigned U.S. patent application Ser. No. 08/538,193, filed Sep. 29, 1995, entitled "APPARATUS FOR REMOVAL OF DEVELOPER LIQUID FROM A DEVEL- OPMENT DEVICE." The entire content of the above-referenced patent application is incorporated herein by reference.

The development roller 14 in each development station can transfer an excessive amount of developer liquid to photoreceptor 16. The squeegee roller 12 in each development station removes at least a portion of the excess developer liquid from photoreceptor 16 to partially dry the developed image. The squeegee roller 12 is loaded against photoreceptor 16 to form a pressure nip. The squeegee roller 12 can be loaded against photoreceptor 16 with, for example, a loading mechanism incorporating a spring mechanism. A backup roller or fixed backup shoe may be positioned behind photoreceptor 16 to provide support at the nip in response to the loading of squeegee roller 12. The loading mechanism also may include a camming mechanism for selectively engaging and disengaging squeegee roller 12 in contact with photoreceptor 16. The moving photoreceptor 16 drives squeegee roller 12 by friction to rotate in the direction indicated by arrow 48. The pressure nip between photoreceptor 16 and the rotating squeegee roller 12 prevents excess developer liquid from passing through the nip and downstream with the photoreceptor. The squeegee roller 12 produces a holdup volume of developer liquid on the upstream side of the nip. The removal of excess developer liquid by squeegee roller 12 results in partial drying of the developed image on photoreceptor 16.

The development roller 14 and squeegee roller 12 can leave an excess volume of developer liquid on photoreceptor 16 upon termination of the application of developer liquid. The excess volume of developer liquid is sometimes referred to as a "drip line." To remove the "drip line," it may be desirable to further incorporate a squeegee apparatus such as that disclosed, for example, in U.S. patent application Ser. No. 08/536,521, filed Sep. 29, 1995, to Brain P. Teschendorf, entitled "APPARATUS AND METHOD FOR REMOVING DEVELOPER LIQUID FROM AN IMAGING SUBSTRATE." The entire content of the above-referenced patent application is incorporated herein by reference.

During prolonged imaging sequences, squeegee roller 12 also can be susceptible to a phenomenon referred to as developer liquid "wrap-around" in which developer liquid overflows a portion of the squeegee roller and is passed downstream with photoreceptor 16. To avoid developer liquid "wrap-around," it may be desirable to further incorporate a squeegee apparatus such as that disclosed, for example, in copending and commonly assigned U.S. patent application Ser. No. 08/536,136, filed Sep. 29, 1995, entitled "APPARATUS AND METHOD FOR REMOVING EXCESS DEVELOPER LIQUID FROM AN IMAGING SUBSTRATE". The entire content of the above-referenced patent application is incorporated herein by reference. As shown in FIG. 1, this squeegee apparatus may include a second squeegee roller 63 with a blade 65 for cleaning the second squeegee roller.

The movement of photoreceptor 16 takes the latent images in the imaging region past each of development stations 36, 38, 40, 42 for development with the differently colored developer liquids applied by development rollers 14. After development stations 36, 38, 40, 42 have developed each of the latent images formed by exposure stations 28, 30, 32, 34, the imaging region of the moving photoreceptor 16 encounters drying station 44. The drying station includes a heated roller 66 that forms a nip with belt roller 22. The heated roller 66 applies heat to photoreceptor 16 to dry the developer liquid applied by development stations 36, 38, 40, 42. An example of a suitable drying station is disclosed in copending and commonly assigned U.S. patent application Ser. No. 08/536,080, filed Sep. 29, 1995, entitled "DRYING METHOD AND APPARATUS FOR ELECTROPHOTOGRAPHY USING LIQUID TONERS."

The imaging region of photoreceptor 16 next arrives at transfer station 46. The transfer station 46 includes an intermediate transfer roller 68 that forms a nip with photoreceptor 16 over belt roller 18 and a heated pressure roller 70 that forms a nip with the intermediate transfer roller. The developer liquid on photoreceptor 16 transfers from the photoreceptor surface to intermediate transfer roller 68 by selective adhesion. The heated pressure roller 70 serves to transfer the image on intermediate transfer roller 68 to an output substrate 72 by application of pressure and/or heat to the output substrate. The output substrate 72 may comprise, for example, paper or film. In this manner, transfer station 46 forms a visible representation of the original multi-color image on output substrate 72. An example of a suitable transfer station is disclosed in copending and commonly assigned U.S. patent application Ser. No. 08/536,687, filed Sep. 29, 1995, entitled "METHOD AND APPARATUS HAVING IMPROVED IMAGE TRANSFER CHARACTERISTICS FOR PRODUCING AN IMAGE ON PLAIN PAPER."

The operation of imaging system 10, as described above, generally is effective in producing a visible representation of an original multi-color image. However, the quality of the image remains a constant concern. The quality of the image can be degraded, in particular, by nonuniform loading force along the length of squeegee roller 12. Nonuniform loading force results in nonuniform pressure along the nip formed between squeegee roller 12 and photoreceptor 16. Due to the nonuniform pressure, squeegee roller 12 removes excess developer liquid from photoreceptor 16 in a nonuniform manner along the width of a developed image. The nonuniformity can result in visible nonuniformities in the developed image, degrading image quality in the ultimate printed image.

In accordance with the present invention, there is provided a squeegee apparatus and method that achieve substantially uniform loading force along the length of the squeegee roller, and thus along the width of the imaging region of the photoreceptor. As a result, the squeegee apparatus and method provide substantially uniform nip pressure, and substantially uniform removal of excess developer liquid from the photoreceptor. The uniform removal of excess developer liquid from the photoreceptor enhances the uniformity of the developed image and the quality of the printed image.

Figure 2:
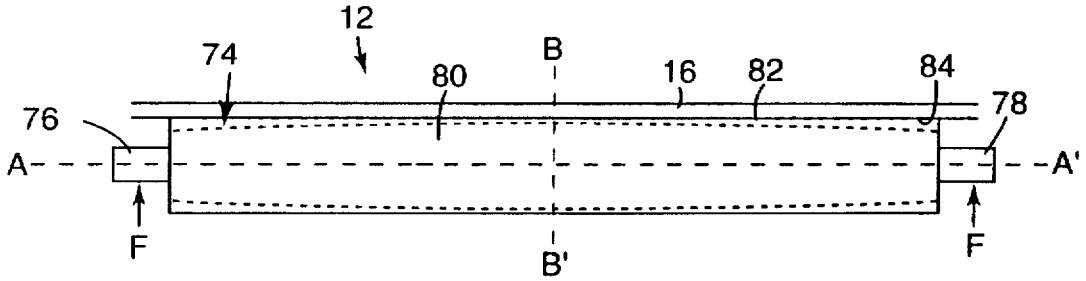
FIG. 2 is a diagram of a squeegee roller, in accordance with the present invention.

FIG. 2 is a diagram of squeegee roller 12 forming part of a squeegee apparatus, in accordance with the present invention. The squeegee roller 12 of FIG. 2 may be used in a squeegee method, in accordance with the present invention. As shown in FIG. 2, squeegee roller 12 has a shaft 74 having a central longitudinal axis A—A'. The shaft 74 has a first end 76, a second end 78, and a core 80 extending between the first end and the second end along central longitudinal axis A—A'. The first end 76, second end 78, and core 80 are concentric about longitudinal axis A—A'. An elastomeric material 82 is formed about core 80. The core 80 has a cross-sectional area oriented perpendicular to longitudinal axis A—A' that varies along the longitudinal axis. As will be explained, the varying cross-sectional area of core 80, in part, enables squeegee roller 12 to distribute loading force in a substantially uniform manner along its length.

The squeegee roller 12 can be mounted within or adjacent to each of development stations 36, 38, 40, 42 in imaging system 10 of FIG. 1. A loading mechanism can be provided to apply a loading force F to each of first end 76 and second end 78. The loading force F is oriented to load core 80 of squeegee roller 12 against photoreceptor 16, thereby forming a pressure nip 84 between elastomeric material 82 and the photoreceptor. A backup roller or fixed backup shoe can be provided on a side of photoreceptor 16 opposite squeegee roller 12 to provide support at nip 84. The loading mechanism can be applied to bearing mounts in which the first end 76 and second end 78 can be mounted. The bearing mounts enable shaft 74 to rotate about longitudinal axis A—A' in response to frictional force generated by contact with photoreceptor 16. In this manner, squeegee roller 12 rotates in the same direction as photoreceptor 16, providing a holdup volume of developer liquid on the upstream side of nip 84.

The cross-sectional area of core 80, oriented perpendicular to longitudinal axis A—A', preferably is substantially circular. Thus, the circular cross-sectional area of core 80 has a diameter that varies along longitudinal axis A—A'. The core 80 preferably has a "crowned" profile such that the diameter of the cross-sectional area is maximum at a midpoint B—B' of the core along the longitudinal axis A—A'. In accordance with the present invention, the cross-sectional area of core 80 and the loading force F applied to each of first end 76 and second end 78 are selected to produce a substantially uniform pressure along nip 84. The substantially uniform pressure provided by squeegee roller 12 along nip 84 thereby removes excess developer liquid from photoreceptor 16 in a substantially uniform manner, resulting in significantly enhanced image quality in the developed image and the ultimate printed image.

The force at midpoint B—B' of a right circular cylindrical core would be less than the force at the opposite end of the core due to axial deflection of shaft 74 in response to force applied to the ends. By varying the diameter of core 80 such that the diameter has a maximum at midpoint B—B', the force at the midpoint can be made substantially equivalent to the force at opposite ends of the core. The increasing diameter of core 80 as it approaches midpoint B—B' results in a more uniform force distribution along pressure nip 84. If the diameter of core 80 is made to continuously vary from one end to the other end with the maximum diameter occurring at midpoint B—B', the resultant force distribution can be rendered constant at some specific force F applied to first end 76 and second end 78. The specific force F sufficient to produce a constant force distribution along nip 84 will depend not only on the profile of core 80, however, but also on the modulus of shaft 74, the length of shaft 74, the modulus of elastomeric material 82, and the thickness of elastomeric material 82. Given selection of the above parameters, one can theoretically calculate a loading force F sufficient to achieve substantially uniform pressure along nip 84. Alternatively, the loading force sufficient to achieve substantially uniform pressure along nip 84 also can be determined by experimentation.

Figure 3:
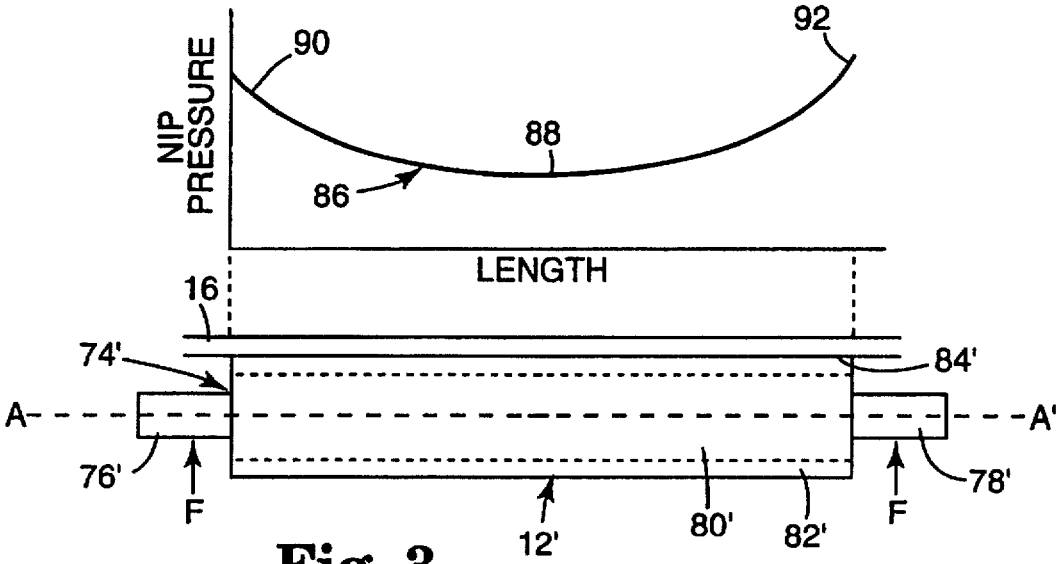
FIG. 3 is a diagram of an existing squeegee roller with a graph conceptually illustrating the loading force along the squeegee roller.

FIG. 3 is a diagram of an existing squeegee roller 12' with a graph conceptually illustrating the loading force along the existing squeegee roller. As shown in FIG. 3, squeegee roller 12' has a cylindrical core 80' that does not vary in diameter along longitudinal axis A—A'. Thus, with a loading force F applied to each of first end 76' and second end 78' of shaft 74', squeegee roller 12' produces a nonuniform distribution of loading force along nip 84'. In particular, curve 86 of the graph of FIG. 3 shows that loading pressure is significantly less at a midpoint 88 of core 80' than at opposite ends 90, 92 of the core. The reduced loading force toward midpoint 88 of core 80' results in nonuniform removal of developer liquid along the width of photoreceptor 16. Consequently, the developed image can be more wet in the center than at the edges. The wet areas can adversely affect the transfer of the developed image to intermediate rollers and the ultimate printing substrate, degrading image quality.

Figure 4:
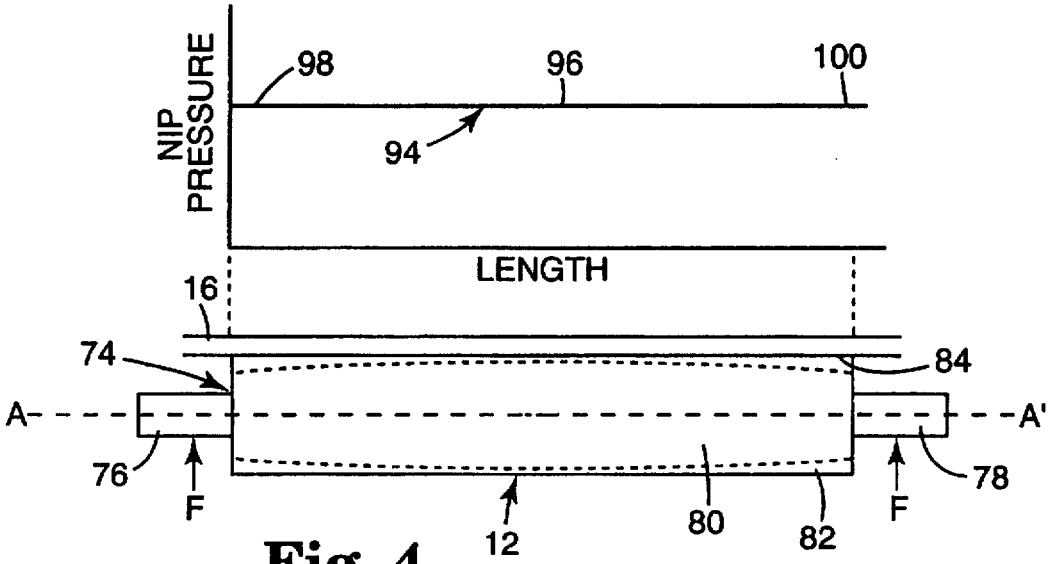
FIG. 4 is a diagram of the squeegee roller of FIG. 2 with a graph conceptually illustrating the loading force along the squeegee roller.

FIG. 4 is a diagram of squeegee roller 12 of FIG. 2 with a graph conceptually illustrating the loading force along the squeegee roller. As shown in FIG. 4 and described above with reference to FIG. 2, squeegee roller 12 has a core 80 that varies in diameter along longitudinal axis A—A', in accordance with the present invention. Thus, with a loading force F applied to each of first end 76 and second end 78, squeegee roller 12 produces a more uniform distribution of loading force along nip 84. In particular, curve 94 of the graph of FIG. 4 shows that loading pressure is substantially constant along core 80, including midpoint 96 and opposite ends 98, 100. The constant loading force along core 80 results in uniform removal of developer liquid along the width of photoreceptor 16, enhancing image quality.

Figure 5:
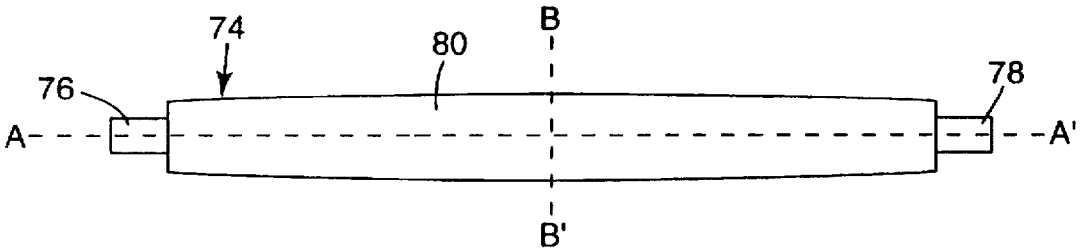
FIG. 5 is a diagram of the shaft and core of the squeegee roller of FIG. 2.

FIG. 5 is a diagram of shaft 74 of squeegee roller 12 of FIG. 2, with core 80 and first and second ends 76, 78, prior to formation of elastomeric material 82. The shaft 74 can be formed from metal or from a substantially rigid non-metal such as, for example, a rigid plastic. Examples of suitable materials for formation of shaft 74 include steel, aluminum, stainless steel, polystyrene, poly vinyl chloride, polycarbonate, acetyl, and carbon-filled fiber glass. The metal or non-metal shaft 74 can be machined to define first end 76, second end 78, and core 80. For ease of manufacturing, however, shaft 74 preferably is cast in a mold to define first end 76, second end 78, and core 80, particularly if the shaft is made of plastic. Although the crowned profile of core 80 can be formed by machining, molding facilitates this operation.

Figure 6:
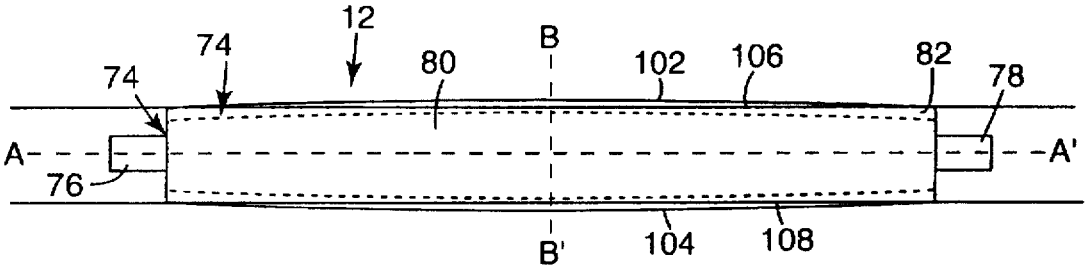
FIG. 6 is a diagram of the squeegee roller of FIG. 2 after formation of an elastomeric material about the 20 core of the shaft shown in FIG. 5.

FIG. 6 is a diagram of squeegee roller 12 of FIG. 2 after formation of elastomeric material 82 about core 80 shown in FIG. 5. Deformation of elastomeric material 82 in response to contact with photoreceptor 16 enables squeegee roller 12 to conform to photoreceptor 16, enhancing uniformity of pressure along nip 84 relative to non-elastomeric materials. The elastomeric material 82 may comprise any of a variety of materials capable of resilient deformation such as, for example, polyurethane, nitrile, neoprene, natural rubber, or synthetic rubber. For uniform developer liquid removal, elastomeric material 82 has a durometer in the range of 10 to 90 Shore A, and preferably in the range of 50 to 70 Shore A. The elastomeric material 82 can be formed about core 80 by placing at least a portion of shaft 74 into a mold. The elastomeric material, in liquid state, is injected into the mold, and allowed to set. The shaft 74, with a layer of elastomeric material 82 formed over core 80, then is removed from the mold to provide squeegee roller 12.

For uniform developer liquid removal, the outer surface of elastomeric material 82 preferably has a consistent texture. To avoid the formation of a parting seam on the surface of elastomeric material 82 upon removal from the mold, the elastomeric material can be formed over core 80 using a right circular cylindrical mold. The use of a right circular cylindrical mold allows squeegee roller 12 to be removed from a circular opening at an end of the mold in a direction along the longitudinal axis A—A' of shaft 74, rather than by separating the mold along the surface of elastomeric material 82. The removal of squeegee roller 12 from the end opening of the mold produces a seamless outer surface of elastomeric material 82.

The right circular cylindrical mold does not conform to the crowned profile of core 80. Thus, in the liquid state, the thickness of elastomeric material 82 extending radially outward from core 80 during molding generally will vary along the length of the core, with the thickness being least at the midpoint and greatest at the ends. After elastomeric material 82 has been removed from the mold and allowed to cool, the elastomeric material will assume a crowned profile. The elastomeric material 82 tends to shrink during cooling in proportion to its thickness in the liquid state. Therefore, the thickest regions of elastomeric material 82 will undergo the most shrinkage, resulting in a substantially crowned contour about crowned core 80, as shown in FIG. 6. The crowned contour of elastomeric material 82 can be retained. If the crowned contour of elastomeric material 82 is retained, the elastomeric material and core 80 together will have a cross-sectional area oriented perpendicular to longitudinal axis A—A' that varies along the longitudinal axis, as indicated by contour lines 102, 104 in FIG. 6. Alternatively, the elastomeric material can be subjected to a post-mold surface processing operation, such as grinding, for example, to impart a desired texture to elastomeric material 82. The surface of elastomeric material 82 can be processed to a crowned profile or to a right circular cylindrical profile. Grinding to a cylindrical profile generally is less difficult that grinding to a non-cylindrical profile and improves repeatability. If the crowned contour of elastomeric material 82 is removed by surface processing to form a right circular cylinder, for example, the elastomeric material and core 80 together will have a cross-sectional area oriented perpendicular to longitudinal axis A—A' that remains substantially constant along the longitudinal axis, as indicated by lines 106, 108 in FIG. 6.

As an alternative to a right circular cylindrical mold with an end opening, elastomeric material 82 can be formed about core 80 using a right circular cylindrical clam-shell mold, or a clam-shell mold shaped to impart a crowned profile to elastomeric material 82. The clam-shell mold can have first and second pieces that are separated to remove elastomeric material 82 and core 80. The clam-shell mold will leave parting seams on elastomeric material 82. In addition, the crowned profile of elastomeric material 82 may be somewhat difficult to repeat. The parting seams can be removed by a post-mold surface processing operation, such as grinding. The surface processing operation also can be used to form elastomeric material 82 to a desired profile and diameter.

The following non-limiting example is provide to further illustrate the structure and functionality underlying a squeegee apparatus and method, in accordance with the present invention.

EXAMPLE

A right circular cylindrical metal shaft having a length of approximately 10.25 inches (26.04 centimeters) and a diameter of approximately 0.64 inches (1.63 centimeters) was machined to form a first end having a length of approximately 0.375 inches (0.95 centimeters) and a diameter of approximately 0.2 inches (0.5 centimeters), a second end having length of approximately 0.375 inches (0.95 centimeters) and a diameter of approximately 0.2 inches (0.5 centimeters), and a core extending between the first end and the second end along the central longitudinal axis of the shaft. The core had a length of approximately 9.5 inches (24.13 centimeters), and was machined to have a diameter that varied along the longitudinal axis. The diameter of the core was maximum at a midpoint of the core and minimum at opposite ends of the core. In particular, the core was machined to have a crowned profile determined by the following equation:

$$L=2[(Dmax-Dmin/2)(2r-(Dmax-Dmin/2))]^{1/2}$$

where the crowned profile conforms to an arc of a circle having a radius r, L is the length of the core, Dmax is a maximum diameter of the core along its length and the diameter of the core at its midpoint, and Dmin is a minimum diameter of the core along its length and the diameter of the core at each of its ends. In this EXAMPLE, r=540 inches (1371.6 centimeters), L=9.5 inches (24.13 centimeters), Dmax=0.625 inches (1.59 centimeters), and Dmin=0.565 inches (1.44 centimeters).

The core of the machined shaft was placed in a right circular cylindrical mold having a length of approximately 9 inches (22.9 centimeters) and a diameter of approximately 0.85 inches (2.16 centimeters). The core was concentric about a central longitudinal axis of the mold. After sealing the mold, an elastomeric material comprising polyurethane was injected into the mold. The elastomeric material had a durometer of approximately 55 to 65 Shore A when set. After allowing the elastomeric material to set, the shaft and elastomeric material were removed from the mold via a circular opening in an end of the mold. The core and elastomeric material of the resulting squeegee roller together had a crowned profile and an overall diameter that varied along the longitudinal axis of the shaft. The elastomeric material was ground to produce a right circular cylindrical squeegee roller in which the core and elastomeric material together produced an overall diameter that was substantially constant along the longitudinal axis of the shaft. The overall diameter of the core and ground elastomeric material was approximately 0.78 inches (1.98 centimeters). The grinding operation provided a texture to the elastomeric material characterized by a random roughness of approximately 40 AA (arithmetic average).

The first and second ends of the squeegee roller were placed in bearing mounts within a development station of a liquid electrographic imaging system. The development station was mounted adjacent a drum carrying a continuous photoreceptor belt within the imaging system. A loading force was applied to the bearing mounts via spring mechanisms to load the squeegee roller against the photoreceptor belt mounted on the drum. The photoreceptor belt had a width of approximately 11 inches (27.9 centimeters) extending parallel to the squeegee roller and a length of approximately 19.8 inches (50.3 centimeters) extending perpendicular to the squeegee roller. The squeegee roller and the photoreceptor belt formed a pressure nip having a length of approximately 9 inches (22.9 centimeters), slightly larger than the width of an imaging region of the photoreceptor belt.

The drum was driven to rotate the photoreceptor belt at a surface velocity of approximately 3 inches (7.62 centimeters) per second. The squeegee roller was frictionally driven by contact with the photoreceptor belt at the same surface velocity. The spring mechanisms were adjusted to experimentally determine a loading force sufficient to produce a substantially uniform force along the nip. It was determined that a loading force of approximately 4 pounds (1.8 kilograms) applied to each of the first end and the second end of the squeegee roller shaft was sufficient to produce such a substantially uniform force along the nip, given the structure of the squeegee roller described above. In operation, the squeegee roller was observed to provide substantially uniform removal of developer liquid across the width of the imaging region of the photoreceptor, resulting in substantially uniform film forming and drying of the developer liquid forming the developed image.

Having described the exemplary embodiments of the present invention, additional advantages and modifications will readily occur to those skilled in the art from consideration of the specification and practice of the invention disclosed herein. Therefore, the specification and examples should be considered exemplary only, with the true scope and spirit of the invention being indicated by the following claims.

What is claimed is:

1. A squeegee apparatus for removing excess developer liquid from an imaging substrate in a liquid electrographic imaging system, the squeegee apparatus comprising:

a squeegee roller having a shaft with a first end, a second end, and a core extending between the first end and the second end along a longitudinal axis of the shaft, and an elastomeric material formed about the core, wherein the core has a cross-sectional area oriented perpendicular to the longitudinal axis that varies along the longitudinal axis; and a loading mechanism for applying a loading force to each of the first end and the second end to load the core of the squeegee roller against the imaging substrate, thereby forming a pressure nip between the elastomeric material and the imaging substrate, wherein the cross-sectional area of the core and the loading force applied to each of the first end and the second end are selected to produce a substantially uniform pressure along the nip, the squeegee roller thereby removing excess developer liquid from the imaging substrate in a substantially uniform manner.

2. The squeegee apparatus of claim 1, wherein the cross-sectional area of the core is substantially circular, the core having a crowned profile such that the cross-sectional area of the core has a diameter that varies along the longitudinal axis of the core, wherein the diameter is maximum at a midpoint of the core along the longitudinal axis.

3. The squeegee apparatus of claim 1, wherein the elastomeric material has a thickness extending outward from the core and perpendicular to the longitudinal axis that varies along the longitudinal axis.

4. The squeegee apparatus of claim 1, wherein the elastomeric material and the core together have a cross-sectional area oriented perpendicular to the longitudinal axis that is substantially constant along the longitudinal axis.

5. The squeegee apparatus of claim 1, wherein the elastomeric material and the core together have a cross-sectional area oriented perpendicular to the longitudinal axis that varies along the longitudinal axis.

6. The squeegee apparatus of claim 1, wherein the shaft comprises a metal.

7. The squeegee apparatus of claim 1, wherein the shaft comprises a substantially rigid non-metal.

8. The squeegee apparatus of claim 1, wherein the elastomeric material has a durometer in the range of approximately 50 to 70 Shore A.

9. The squeegee apparatus of claim 1, wherein the core has a length sufficient to extend at least along a width of an imaging region of the imaging substrate.

10. The squeegee apparatus of claim 1, wherein the imaging substrate comprises a photoreceptor.

11. A liquid electrographic imaging system comprising:

an imaging substrate;

means for moving the imaging substrate in a first direction;

means for forming a latent electrostatic image on an imaging region of the imaging substrate;

a development station for delivering developer liquid to the imaging region of the imaging substrate to develop the latent electrostatic image;

a squeegee apparatus for removing excess developer liquid from the imaging substrate, the squeegee apparatus comprising:

a squeegee roller having a shaft with a first end, a second end, and a core extending between the first end and the second end along a longitudinal axis of the shaft, and an elastomeric material formed about the core, wherein the core has a cross-sectional area oriented perpendicular to the longitudinal axis that varies along the longitudinal axis; and a loading mechanism for applying a loading force to each of the first end and the second end to load the core of the squeegee roller against the imaging substrate, thereby forming a pressure nip between the elastomeric material and the imaging substrate, wherein the cross-sectional area of the core and the force applied to each of the first end and the second end are selected to produce a substantially uniform pressure along the nip, the squeegee roller thereby removing excess developer liquid from the imaging substrate in a substantially uniform manner; and means for transferring the developer liquid remaining on the imaging region of the imaging substrate to an output substrate, thereby forming a visible representation of an image.

12. The imaging system of claim 11, wherein the cross-sectional area of the core is substantially circular, the core having a crowned profile such that the cross-sectional area of the core has a diameter that varies along the longitudinal axis of the core, wherein the diameter is maximum at a midpoint of the core along the longitudinal axis.

13. The imaging system of claim 12, wherein the core has a length sufficient to extend at least along a width of an imaging region of the imaging substrate.

14. The imaging system of claim 11, wherein the elastomeric material has a thickness extending outward from the core and perpendicular to the longitudinal axis that varies along the longitudinal axis.

15. The imaging system of claim 11, wherein the elastomeric material and the core together have a cross-sectional area oriented perpendicular to the longitudinal axis that is substantially constant along the longitudinal axis.

16. The imaging system of claim 11, wherein the elastomeric material and the core together have a cross-sectional area oriented perpendicular to the longitudinal axis that varies along the longitudinal axis.

17. The imaging system of claim 11, wherein the shaft comprises a metal.

18. The imaging system of claim 11, wherein the shaft comprises a substantially rigid non-metal.

19. The imaging system of claim 11, wherein the elastomeric material has a durometer in the range of approximately 50 to 70 Shore A.

20. The imaging system of claim 11, wherein the imaging substrate comprises a photoreceptor.

21. A squeegee method for removing excess developer liquid from an imaging substrate in a liquid electrographic imaging system, the method comprising the steps of:

providing a squeegee roller having a shaft with a first end, a second end, and a core extending between the first end and the second end along a longitudinal axis of the shaft, and an elastomeric material formed about the core, wherein the core has a cross-sectional area oriented perpendicular to the longitudinal axis that varies along the longitudinal axis; and applying a loading force to each of the first end and the second end to load the core of the squeegee roller against the imaging substrate, thereby forming a pressure nip between the elastomeric material and the imaging substrate, wherein the cross-sectional area of the core and the loading force applied to each of the first end and the second end are selected to produce a substantially uniform pressure along the nip, the squeegee roller thereby removing excess developer liquid from the imaging substrate in a substantially uniform manner.

22. The squeegee method of claim 21, wherein the cross-sectional area of the core is substantially circular, the core having a crowned profile such that the cross-sectional area of the core has a diameter that varies along the longitudinal axis of the core, wherein the diameter is maximum at a midpoint of the core along the longitudinal axis.

23. The squeegee method of claim 21, wherein the elastomeric material has a thickness extending outward from the core and perpendicular to the longitudinal axis that varies along the longitudinal axis.

24. The squeegee method of claim 21, wherein the elastomeric material and the core together have a cross-sectional area oriented perpendicular to the longitudinal axis that is substantially constant along the longitudinal axis.

25. The squeegee method of claim 21, wherein the elastomeric material and the core together have a cross-sectional area oriented perpendicular to the longitudinal axis that varies along the longitudinal axis.

26. The squeegee method of claim 21, wherein the shaft comprises a metal.

27. The squeegee method of claim 21, wherein the shaft comprises a substantially rigid non-metal.

28. The squeegee method of claim 21, wherein the elastomeric material has a durometer in the range of approximately 50 to 70 Shore A.

29. The squeegee method of claim 21, wherein the core has a length sufficient to extend at least along a width of an imaging region of the imaging substrate.

30. The squeegee method of claim 21, wherein the imaging substrate comprises a photoreceptor.

* * * * *